United States Patent [19]

Matsunaga et al.

[11] Patent Number: 5,012,715

[45] Date of Patent: May 7, 1991

[54] SENSOR FOR AN AUTOMATIC PIANO PLAYER APPARATUS

[75] Inventors: Hiroshi Matsunaga, Hamamatsu; Hisamitsu Honda, Shizuoka; Haruhiko Matsui; Masahiko Akita; Tatsuya Inaba; Tetsusai Kondo; Toshio Oka, Hamamatsu, all of Japan

[73] Assignee: Kabushiki Kaisha Kawai Gakki Seisakusho, Hamamatsu, Japan

[21] Appl. No.: 388,561

[22] Filed: Aug. 2, 1989

[30] Foreign Application Priority Data

Aug. 3, 1988 [JP] Japan ..... 63-192797
Apr. 14, 1989 [JP] Japan ..... 1-94415

[51] Int. Cl.[5] ..... G10C 3/18; G10H 1/34; G10H 3/06

[52] U.S. Cl. ..... 84/724; 84/745; 84/DIG. 7

[58] Field of Search ..... 84/DIG. 7, 626, 658, 84/670, 687-690, 720, 724, 745, 21, 22; 341/27, 31

[56] References Cited

U.S. PATENT DOCUMENTS 4,307,648 12/1981 Stahnke ..... 84/452
4,362,934 12/1982 McLey ..... 250/229
4,913,026 3/1990 Koreko ..... 84/DIG. 7 X

FOREIGN PATENT DOCUMENTS 56-33718 8/1981 Japan .
59-24894 2/1984 Japan .
59-30595 2/1984 Japan .
59-30596 2/1984 Japan .
59-91494 5/1984 Japan .
60-39690 3/1985 Japan .
61-12190 5/1986 Japan .

*Primary Examiner*—William M. Shoop, Jr.
*Assistant Examiner*—Brian Sircus
*Attorney, Agent, or Firm*—Michael N. Meller

[57] ABSTRACT

A sensor arrangement for an automatic piano player apparatus is provided. The sensor arrangement includes a plurality of switches which are operatively associated with a rotatable shutter in the hammer system of the automatic piano player. When the hammer system is operated to strike a string of the piano, the cooperation between the rotatable shutter and the switches produces output information which includes the string-striking intensity information and the state of condition information of the damper that is normally in contact with the piano string. With this information, the various play techniques such as staccato, legato, continuous key-striking and the like may be reproduced with great fidelity by the automatic piano player apparatus.

10 Claims, 8 Drawing Sheets

SENSOR FOR AN AUTOMATIC PIANO PLAYER APPARATUS

The present invention relates to automatic piano players. More particularly, the present invention relates to information sensor apparatus for an automatic piano player.

In an automatic piano player apparatus equipped with an action mechanism for striking a string by a hammer interlocked with a key, this invention relates to a play information sensor capable of detecting with fidelity all the play information necessary for automatic playing.

BACKGROUND OF THE INVENTION

As is known, the piano generates sound when a key is depressed to cause a hammer to strike a string. Before the hammer comes in touch with the string, a damper is removed from the string. When key depression is stopped and the key is released, the damper again comes into contact with the string to check the string vibration and stop the sound.

As described above, sound generation and sound stop are carried out respectively by different mechanisms. Moreover, the keyboard, the hammer and the damper are connected to one another through many link mechanisms. For these reasons, the motion of the key and those of the hammer and damper differ with various play techniques such as staccato, legato, continuous key-striking and the like, so that it is impractical to relate them unitarily with one another. To reproduce the original play with fidelity using an automatic piano player apparatus, therefore, it is necessary to extract and record information of both the string-striking intensity of the hammer and that of the sound stop resulting from the key release on the keyboard.

In a conventional autopiano or automatic piano player apparatus, the key-depression information (sound stop information) is obtained from the keyboard portion and the string-striking intensity information of the hammer from the hammer or a catcher.

In the conventional apparatus described above, a sensor for obtaining the key-depression information (sound stop information) and a sensor for obtaining the string-striking intensity information of the hammer must be located at different positions. This gives rise to the problems of complicated adjustment procedures and a higher production cost.

The present invention has for its object to solve these problems observed with the prior art.

To accomplish the object described above, a sensor arrangement for an automatic piano player apparatus in accordance with the present invention comprises switches disposed in the proximity of a hammer system of a piano. The switches are turned on and off at a point of time A when a damper starts leaving a string in accordance with the rotating action of the hammer system. They are also activated at a point of time B when the hammer system has rotated through a predetermined angle, at a point of time C when the hammer system has rotated through a further predetermined angle and at a point of time D when the sound stops, respectively. The sensor arrangement also includes information output means for obtaining a key position information corresponding to a depressed key from the outputs of the switches, a string-striking intensity information corresponding to the time length between the point of time B and the point of time C from the outputs of the switches at the points of time B and C, and a state-of-condition information of the damper from the time between the point of time A and the point of time D from the outputs of the switches at the points of time A and D. The switches described above either comprise a first switch turning on and off at the points of time A, C and D and a second switch turning on and off at the point of time B, or comprise a first switch turning on and off at the points of time A and D, a second switch turning on and off at the point of time B, and a third switch turning on and off at the point of time C.

The first and second switches or the first, second and third switches are preferably disposed at desired distances apart in the rotating direction of the hammer system or at desired intervals in the radial direction with respect to the rotating plane of the hammer system. Preferably, each switch comprises a light emission element, a light reception element disposed opposite the light emission element and a shutter passing between the light emission element and the light reception element.

The above objects and other advantages of the present invention will become more apparent by describing the preferred embodiments of the present invention in detail with reference to the attached drawings in which.

Hereinafter, embodiments of the present invention will be described with reference to the drawings.

Figure 1:
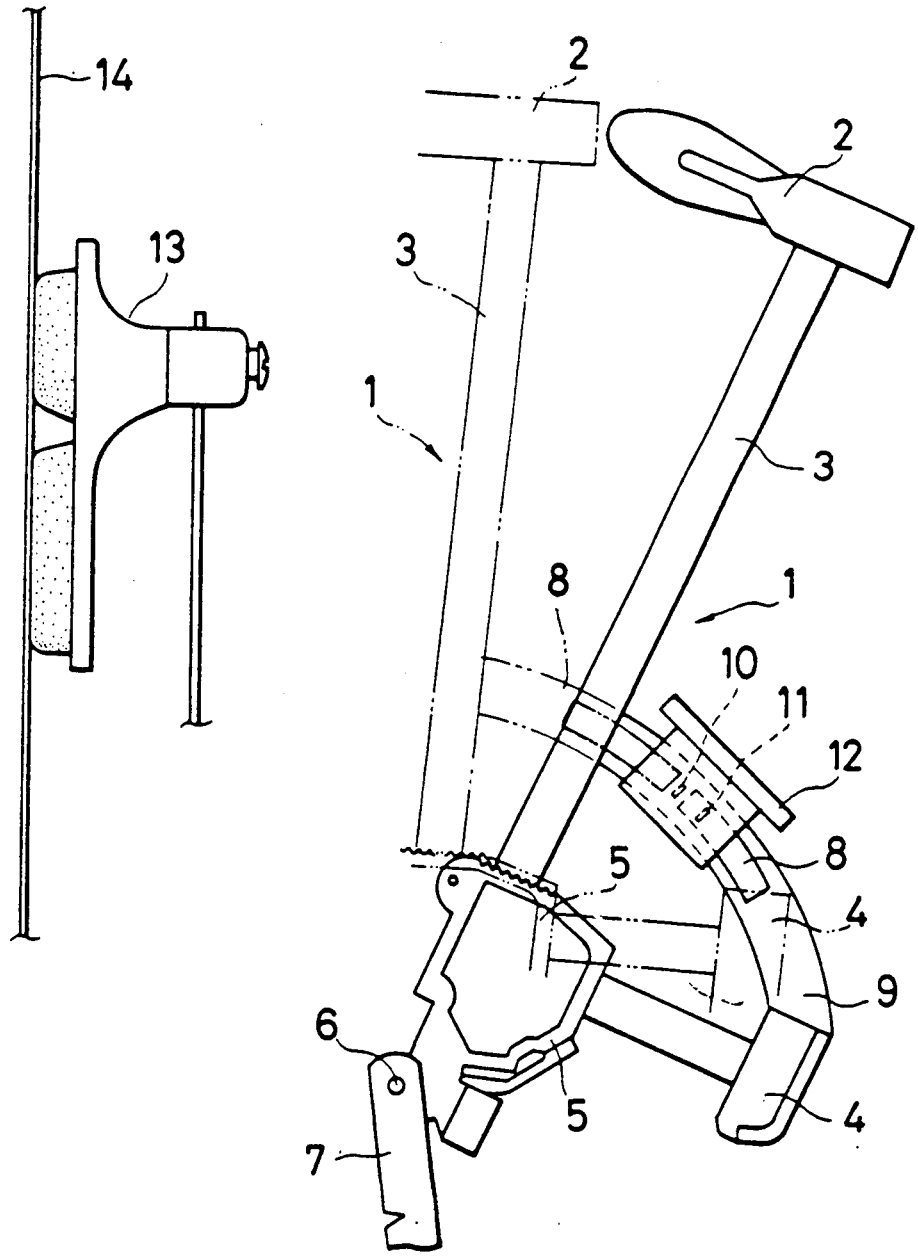
FIG. 1 is a side view showing principal portions embodiment of the present invention.

FIG. 1 shows the principal portions of an embodiment of the present invention.

In FIG. 1, reference numeral 1 represents a hammer system consisting of a hammer 2, a hammer shank 3, a catcher 4 and a butt 5. The hammer system is supported rotatably on a flange 7 by a center pin 6. A shutter 9 is in an arcuate form with its center at the center pin 6. Shutter 9 is provided with a shutter window 8 and is securely fastened at one of its ends to the hammer shank 3 and at the other to the catcher 4 of the hammer system 1. First and second switches 10 and 11 are housed in a housing 12 fastened to a member not shown in the drawing.

Figure 5:
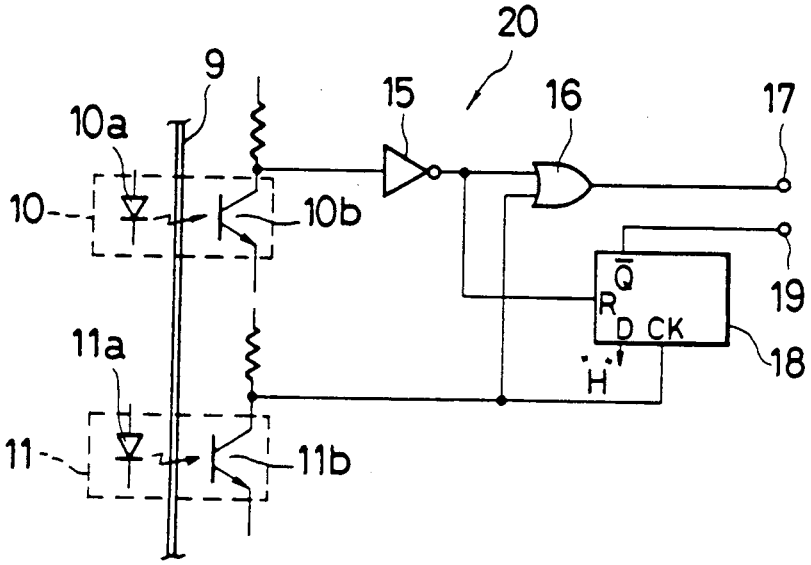
FIG. 5 is a circuit diagram showing an information separation circuit.

As can be clearly seen from FIG. 5, each switch 10, 11 is a photoelectric switch comprising a light emission portion 10*a*, 11*a* and a light reception portion 10*b*, 11*b* respectively disposed in such manner as to interpose the shutter 9 between them.

That is, the light emission portion and the light reception portion of each of the switches 10 and 11 are respectively located on opposite sides of the path followed by the arcuate shutter 9 as it rotates about the center pin 6. The shutter 9 prevents the transmission of light between the switch portions except when the shutter window 8 permits such transmission.

The switches are disposed a desired distance apart in the rotating direction of the hammer system. When a key is released ($t_1$) (see FIG. 2), the ray of light of the light emission portion 10*a* of the first switch 10 is cut off by the shutter 9. When the key is depressed, the hammer system 1 starts rotating and a damper 13 starts leaving a string 14 ($t_2$), the light reception portion 10*b* of the first switch 10 receives the rays of light of the light emission portion 10*a* through the shutter window 8. Immediately before the hammer 2 strikes the string 14 ($t_4$), the shutter 9 intercepts the ray of light of the light emission portion 10*a*.

When the hammer system rotates further ($t_5$) the hammer strikes the string and due to its reaction, the hammer system starts rotating in the reverse direction. At a certain point of time ($t_6$), the light reception portion 10*b* again receives the ray of light of the light emission portion 10*a*. When the key is released and the damper 13 comes into contact with the string 14 ($t_8$), the ray of light of the light emission portion 10*a* is cut off by the shutter 9.

The light reception portion 11*b* of the second switch 11 operates as follows. It receives the ray of light of the light emission portion 11*a* when the key is released ($t_1$). At the point of time ($t_3$), which is before the time $t_4$ described above, when the key is depressed and the hammer system 1 starts rotating and rotates through an arbitrary angle, the ray of light of the light emission portion 11*a* is cut off by the shutter. At the point of time ($t_5$), the hammer strikes the string and due to its reaction, the hammer system 1 starts rotating in the reverse direction. At the point of time ($t_7$) after $t_6$, the light reception portion 11*b* receives again the ray of light from the light emission portion 11*a*.

Figure 2:
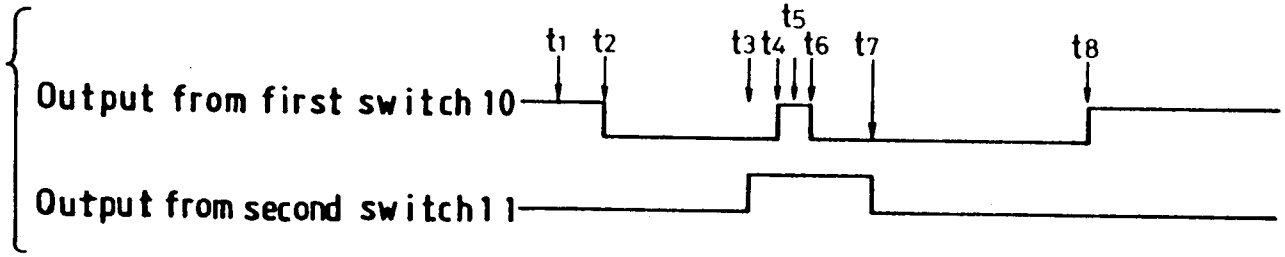
FIGS. 2, 3, 4 are time diagrams showing the changes in the outputs of the first and second switches of FIG. 1 when in different types of play.
Figure 3:
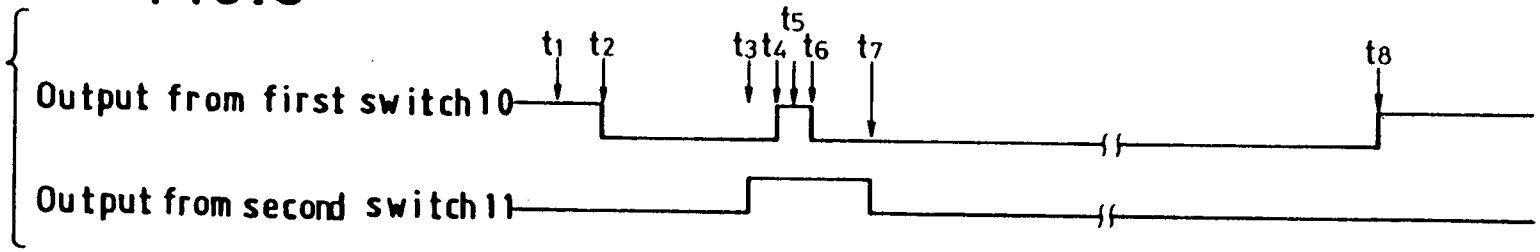
Figure 4:
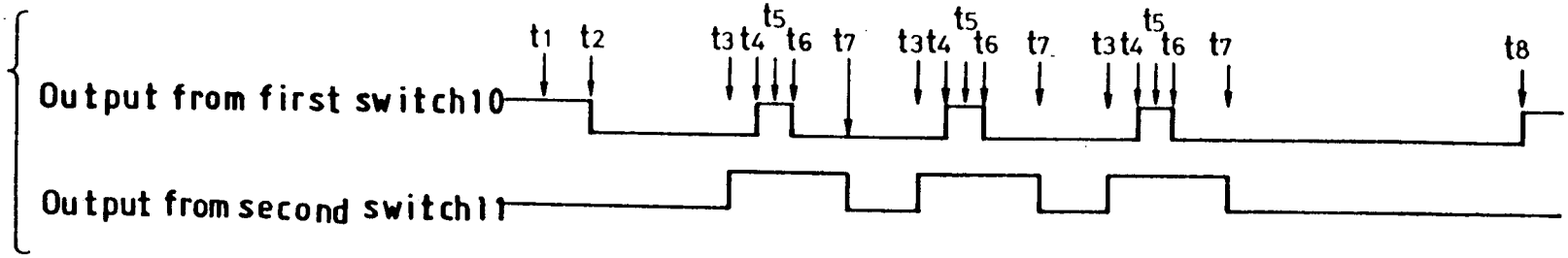

FIGS. 2 to 4 are time charts which show the time points $t_1$ to $t_8$ and the outputs of the first and second switches 10, 11 at these time points.

FIG. 2 shows the outputs of the first and second switches 10, 11 at each point $t_1 \sim t_8$ when a string is struck by staccato. FIGS. 3 and 4 show the outputs of the first and second switches 10, 11 when the string is struck in legato and continuous key-striking play, respectively.

In the case of the legato shown in FIG. 3, the output form is the same as in the staccato from the points $t_1$ to $t_7$, but since the key is depressed for a longer time in the legato, the time length from the points $t_7$ to $t_8$ becomes longer.

What makes the continuous key-striking play shown in FIG. 4 particularly different from other plays is the fact that a key depression made as shown in FIG. 1 is followed by the next one before it is released sufficiently, so that the absence of the point $t_8$ after the point $t_7$ is often observed. FIG. 4 also shows that the damper 13 is out of contact with the string 14 over the period of time from the point $t_2$ to the point $t_8$.

FIG. 5 shows an information separation circuit 20 serving as information output means for providing the string-striking intensity information and the state-of-condition information of the damper from the outputs of the first and second switches 10, 11.

Figure 6:
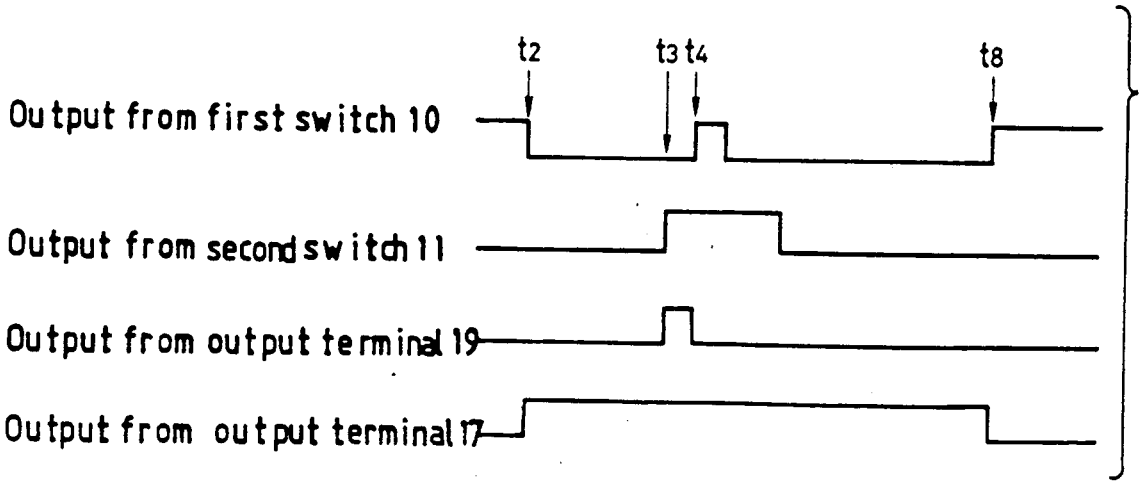
FIG. 6 is a time diagram showing the outputs from the output terminals of the information separation circuit of FIG. 5 and the changes in the outputs of the switches.

In FIG. 5, reference number 15 represents a NOT circuit for reversing the output of the light reception portion 10*b* of the first switch 10 and its output is connected to an output terminal 17 through an OR circuit 16 and to a reset terminal R of a flip-flop 18 such as the 74LS74, for example. The output of the light reception portion 11*b* of the second switch 11 is connected to the clock terminal CK of the flip-flop 18, its output terminal $\overline{Q}$ is connected to the output terminal 19 and a high-level voltage "H" is applied to the terminal D of the flip-flop 18. As shown in FIG. 6, the state-of-condition information of the damper 13 is provided from the output terminal 17 and the string-striking intensity information having a pulse width corresponding to the string-striking intensity is provided from the output terminal 19.

Though the sound generation is actually made at the point $t_5$, the point $t_4$ may be used as the sound generation point of time without any practical problem because the time interval between $t_4$ and $t_5$ is extremely short (e.g., about 0.5 to about 10 msec).

When the key is depressed and the hammer system rotates, the switch is turned on and off at the point of time A when the damper starts leaving the string. Accordingly, key position information corresponding to the depressed key can be obtained from its output. Next, at the point of time B when the hammer system has rotated through a predetermined angle and at the point of time C when it has rotated through another predetermined angle to reach a string-striking point, for example, the switches are sequentially turned on and off. The length of time between the point of time B and the point of time C is inversely proportional to the hammer speed or in other words, to the string-striking intensity. Therefore, the information output means can obtain the key-striking intensity information corresponding to the time length described above from the outputs of the switches at these points of time B and C. The switch is again turned on and off at the point of time D for stopping the sound. Therefore, the information output means can further obtain the damper-state information involving the time corresponding to the interval between the points of time A and D from the output of the switch at the point of time A when the damper starts leaving the string and at the point of D when the sound stops.

Figure 7:
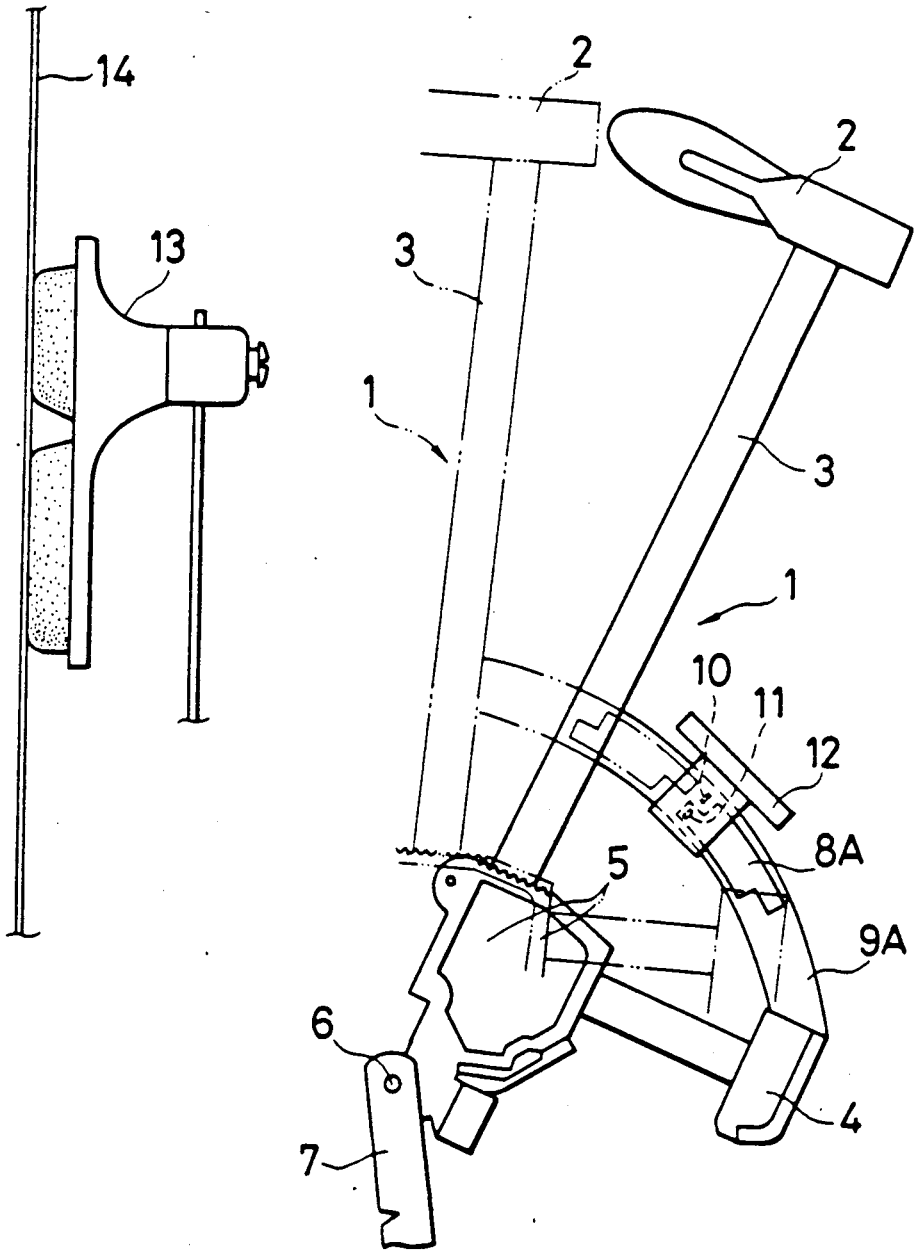
FIG. 7 is a side view showing a variation of the embodiment shown FIG. 1.

FIG. 7 shows another embodiment of the present invention wherein the disposition of the first and second switches 10, 11 is different.

In the drawing, the first and second switches 10 and 11 are disposed a desired distance apart in a radial direction with respect to the rotating plane of the hammer system. The shutter window 8A of the shutter 9A facing them is formed with such a shape that when the shutter 9A rotates, the first and second switches 10, 11 may operate at the points $t_1 \sim t_8$ of FIG. 2 in the same way as the first and second switches 10, 11 shown in FIG. 1.

In the two embodiments described above, the key position information of the depressed key is obtained from the output of the first switch but is omitted from the drawing.

Figure 8:
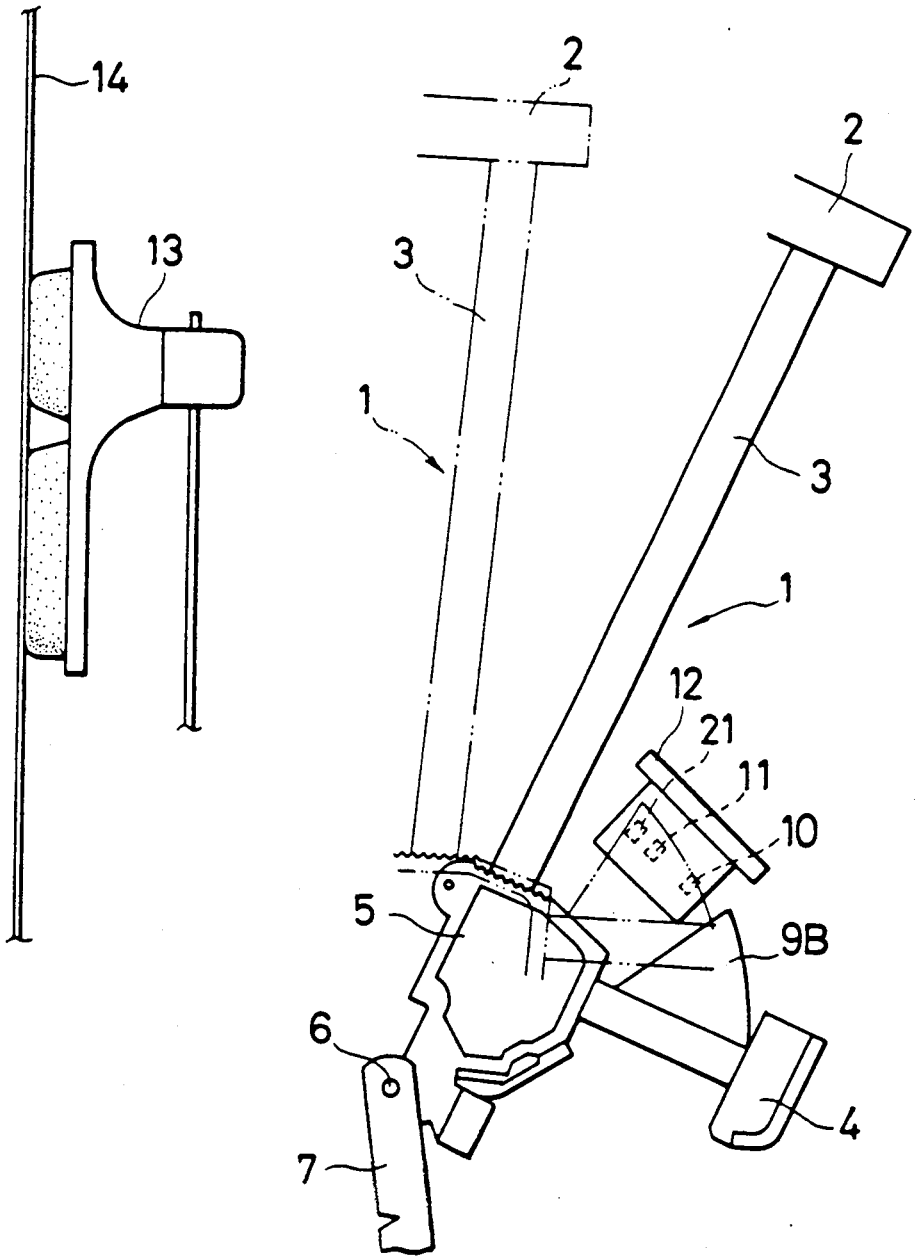
FIG. 8 is a side view showing the principal portions of another embodiment of the present invention using three switches.

FIG. 8 shows still another embodiment of the present invention which uses a third switch 21 in addition to the first and second switches 10 and 11.

The first, second and third switches 10, 11 and 21 are disposed inside the casing 12 desired distances apart in the rotating direction of the hammer system 1. The shutter 9B has a fan-shape and is fixed to the catcher 4.

Each of the first, second and third switches 10, 11, 21 is a photoelectric switch consisting of a light emission portion 10*a*, 11*a*, 21*a* and a light reception portion 10*b*, 11*b*, 21*b* which are all so disposed that the shutter 9B passess therebetween. The light reception portion 10*b* of the first switch 10 receives the ray of light of the light emission portion 10*a* when a key is depressed ($t_1$).

At the point of time ($t_2$) when the key is struck, the hammer system 1 starts rotating and the damper 13 starts leaving the string 14. The ray of light of the light emission portion 10*a* is cut off. When the key is released and the damper 13 comes again into contact with the string 14 (at the point $t_8$), the ray of light of the light emission portion 10*a* is again cut off by the shutter 9B.

The light reception portion 11*b* of the second switch 11 receives the ray of light of the light emission portion 11*a* when the key is released ($t_1$). At the point ($t_3$) when a key is depressed and the hammer system 1 starts rotating and rotates through a predetermined angle, the ray of light of the light emission portion 11*a* is cut off by the shutter 9B and the string is struck. Due to its reaction, the hammer system 1 starts rotating in the reverse direction and the light reception portion 11*b* of the second switch 11 again receives the ray of light of the light emission portion 11*a* at a certain point receives the ray of light of the light emission portion 21*a* when the key is released ($t_1$). The key is then struck to cause the hammer system 1 to begin rotating, and the ray of light of the light emission portion 21*a* is cut off from the light reception portion 21*b* at the point ($t_4$) immediately before the hammer 2 strikes the string 14. As the hammer system 1 rotates further to strike the string (at the point $t_5$), the hammer system 1 starts rotating in the reverse direction due to reaction of the string-striking, and the light reception portion 21*b* again receives the ray of light of the light emission portion 21*a* at the point ($t_6$) before the point ($t_7$) described above.

Figure 9:
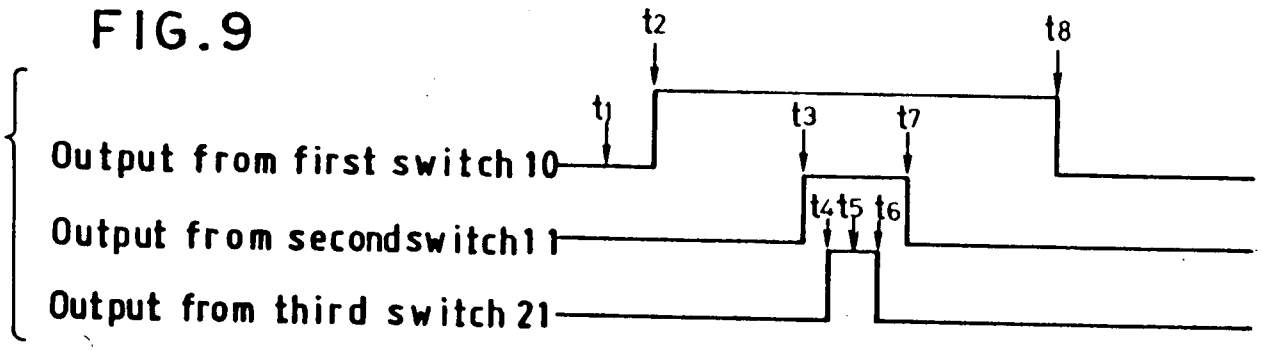
FIGS. 9, 10 and 11 are time diagrams showning the change in the outputs of the first, second and third switches of FIG. 8.
Figure 10:
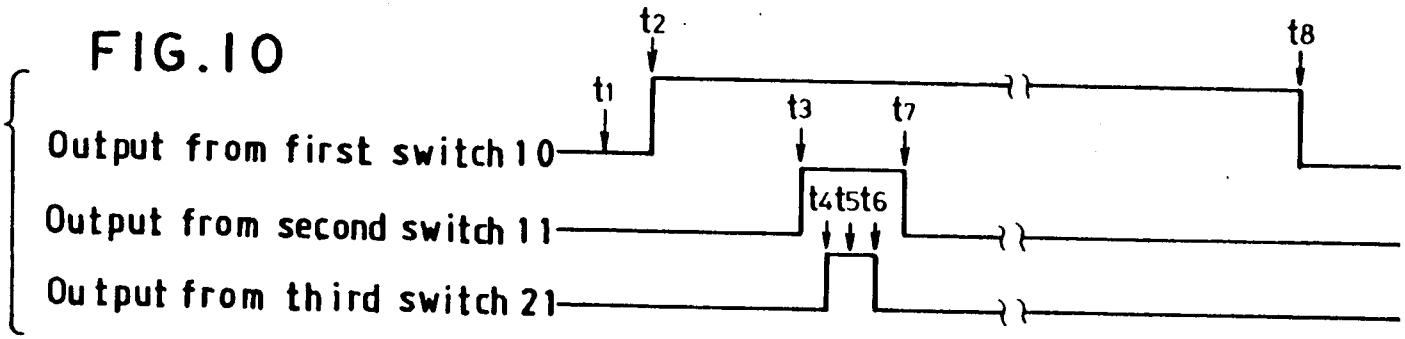
Figure 11:
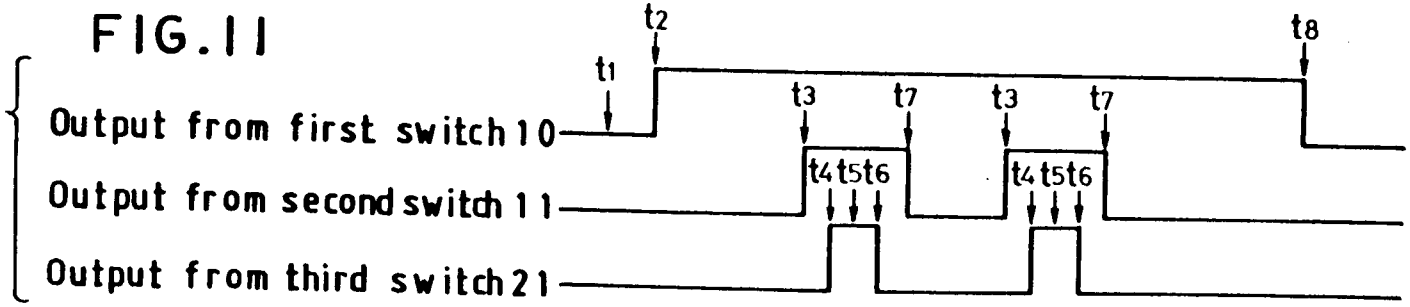

FIGS. 9 to 11 are time charts showing the time points $t_1 \sim t_8$ described above and the outputs of the first, second and third switches 10, 11 and 21 at these time points.

FIG. 9 is the time chart in the case of the play in staccato, and FIGS. 10 and 11 are the time charts in the case of the play in legato and continuous key-striking, respectively.

Figure 12:
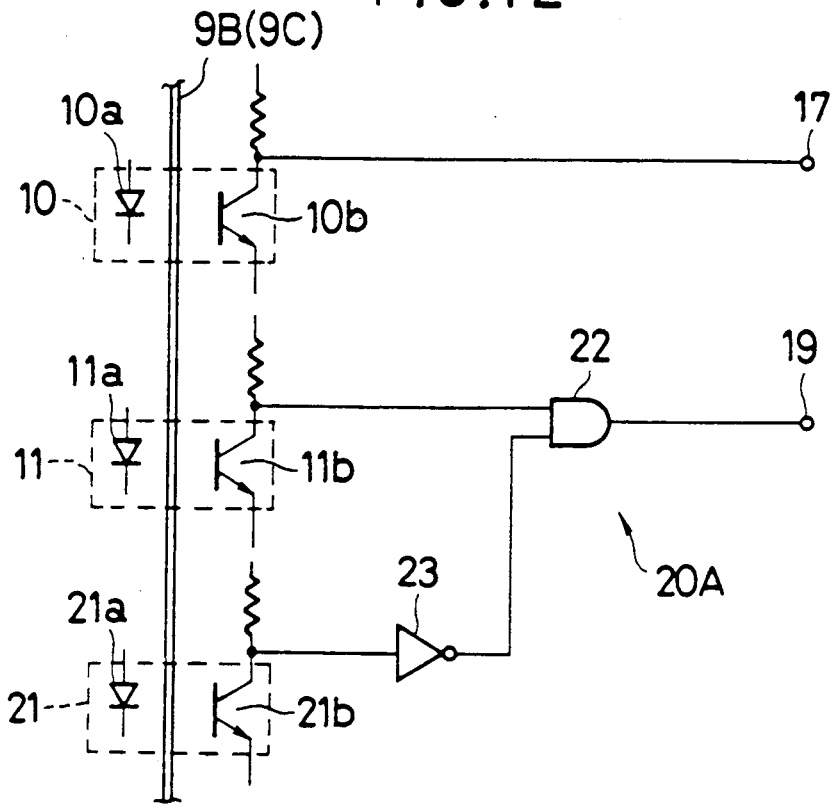
FIG. 12 is a circuit diagram of the information separation circuit used in the embodiment shown in FIGS. 8 and 14.

FIG. 12 shows an information separation circuit 20A serving as information output means for providing the string-striking intensity information and the state-of-condition information of the damper from the outputs of the first, second and third switches 10, 11 and 21 respectively.

Figure 13:
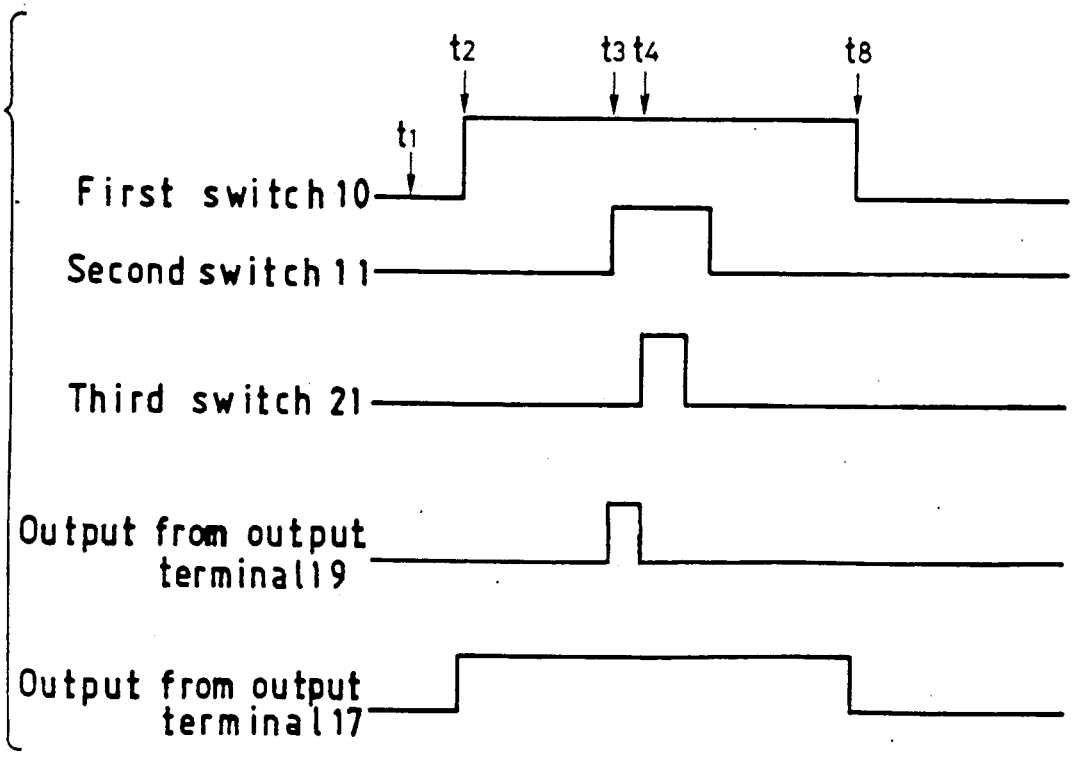
FIG. 13 is a time diagram showing the outputs from the output terminals of the information separation circuit and the change in the outputs.

In FIG. 12, reference number 22 represents an AND circuit. One of the input terminals of the AND circuit 22 is connected to the output terminal of the second switch 11 and the other of the input terminals is connected to the output terminal of the third switch 21 through a NOT circuit 23. As shown in FIG. 13, the string-striking intensity information having a pulse width extending from the time $t_3$ to the time $t_4$, said pulse width corresponding to the string-striking intensity, is provided from the output terminal 19 of the AND circuit 22. The state-of-condition information representing high-level position of the damper 13 during the period from the time $t_2$ to the time $t_8$ is provided from the output terminal 17.

Figure 14:
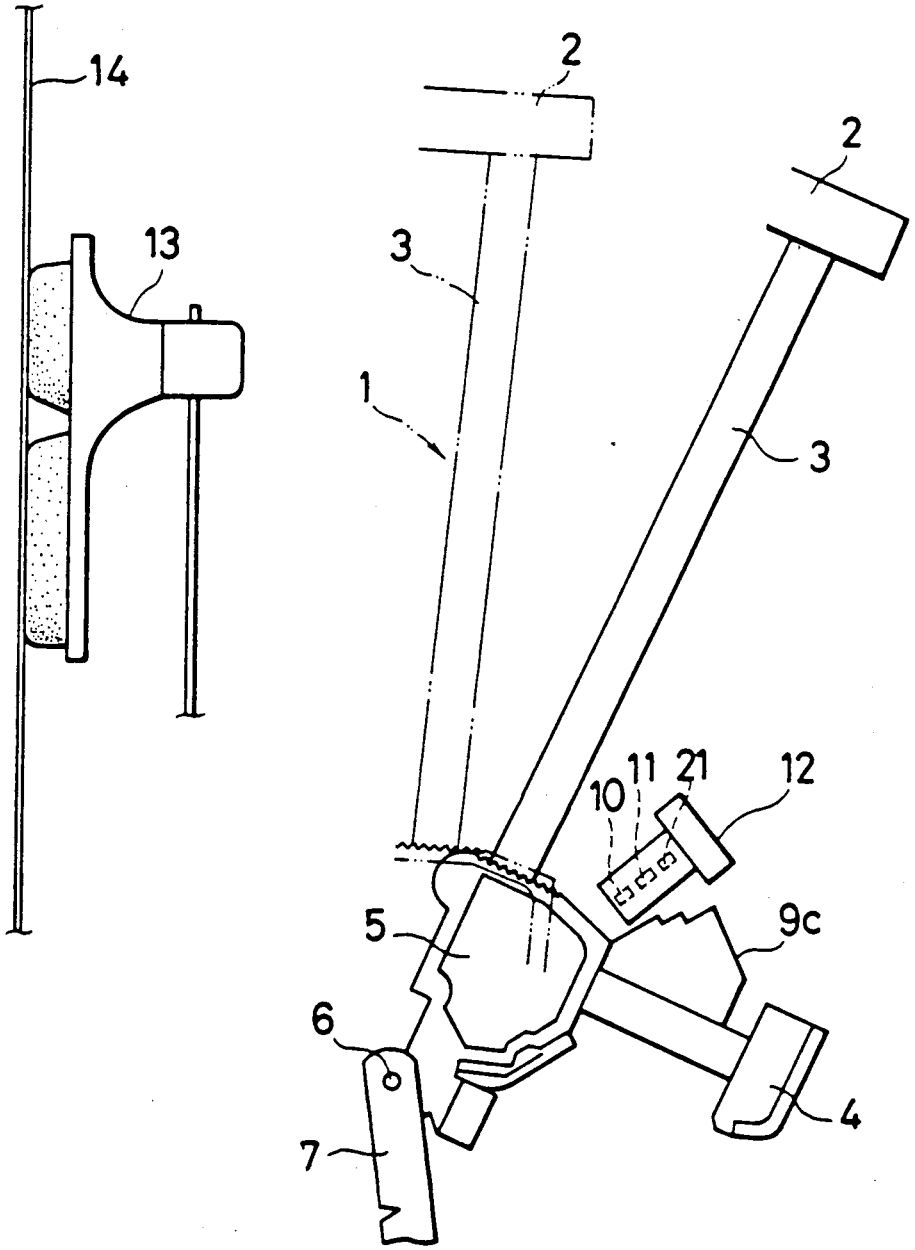
FIG. 14 is a side view showing a variation of the embodiment shown in FIG. 8.

FIG. 14 shows still another embodiment of the present invention showing a different disposition of the first, second and third switches 10, 11 and 21.

In this drawing, the first, second and third switches 10, 11 and 21 are disposed at desired intervals in the radial direction with respect to the rotary plane of the hammer system 1. The edge of the shutter 9C cooperating with them is formed in such a shape that when the shutter 9*c* rotates, the first, second and third switches 10, 11 and 21 operate at the time points $t_1 \sim t_8$ shown in FIGS. 9, 10 and 11 in the same way as the first, second and third switches 10, 11 and 21 shown in FIG. 8 do.

In the embodiments shown in FIGS. 8 and 14, the key position information corresponding to the depressed key is obtained from the output of the first switch 10, but it is omitted from the drawings.

As described above, according to the present invention, the string-striking intensity information and the damper's state-of-condition information are obtained only by the switches disposed in the proximity of the hammer system. This brings about the effect of making installation and adjustment thereof easy.

What is claimed is:

1. A sensor arrangement for an automatic piano player apparatus, said apparatus having a keyboard, piano strings, each of said strings having a damper mechanism and a rotatable hammer system for striking a piano string in response to depression of a key in said keyboard comprising:

a plurality of switches operatively associated with said hammer system and being turned on and off at a point of time A when a damper starts leaving a string in response to the rotating action of said hammer system, at a point of time B when said hammer system has rotated through a predetermined angle, at a point of time C when said hammer system has rotated through another predetermined angle and at a point of time D when the sound stops, respectively; and information output means for obtaining a key position information corresponding to a depressed key from the outputs of said switches, a string-striking intensity information corresponding to the time length between said point of time B and said point of time C from the outputs of said switches at said points of time B and C, and a state-of-condition information of said damper over the time between said point of time A and said point of time D from the outputs of said switches at said points of time A and D.

2. The sensor arrangement for an automatic piano player apparatus according to claim 1, wherein said switches comprise a first switch that turns on and off at said points of time A, C and D, respectively, and a second switch that turns on and off at said point of time B.

3. The sensor arrangement for an automatic piano player apparatus according to claim 2, wherein said first and second switches are disposed a desired distance apart in the rotating direction of said hammer system.

4. The sensor arrangement for an automatic piano player apparatus according to claim 2, wherein said first and second switches are disposed a desired distance apart in a radial direction with respect to the rotating plane of said hammer system.

5. The sensor arrangement for an automatic piano player apparatus according to claim 1, wherein said switches comprise a first switch that turns on and off at said points of time A and D, a second switch that turns on and off at said point of time B, and a third switch that turns on and off at said point of time C.

6. The sensor arrangement for an automatic piano player apparatus according to claim 5, wherein said first, second and third switches are disposed desired distances apart in the rotating direction of said hammer system.

7. The sensor arrangement for an automatic piano player apparatus according to claim 5, wherein said first, second and third switches are disposed at desired distances apart in a radial direction with respect to the rotating plane of said hammer system.

8. The sensor arrangement for an automatic piano player apparatus according to claim 1, wherein each of said switches comprises a light emission element, a light reception element disposed opposite said light emission element, and said hammer system including a rotatable shutter passing between said light emission element and said light reception element.

9. The sensor arrangement according to claim 8 wherein said rotatable shutter has a shutter window therein.

10. The sensor arrangement according to claim 9 wherein said shutter window has a preselected shape with respect to the positions of said switches so as to produce a predetermined time pulse pattern.

* * * * *